US005433518A

United States Patent [19]

Skov

[11] Patent Number: 5,433,518

[45] Date of Patent: Jul. 18, 1995

[54] DRAWER ASSEMBLY AND METHOD THEREFOR

[75] Inventor: Erik L. Skov, Wooster, Ohio

[73] Assignee: Rubbermaid Incorporated, Wooster, Ohio

[21] Appl. No.: 157,307

[22] Filed: Nov. 26, 1993

[51] Int. Cl.[6] ..... A47B 88/00

[52] U.S. Cl. ..... 312/348.1

[58] Field of Search ..... 312/348.1–348.4, 312/330.1; 220/6, 7; 52/588.1, 590.2, 592.1; 403/334, 374, 380, 409.1, 381; 404/11, 12, 37, 47

[56] References Cited

U.S. PATENT DOCUMENTS

| | | | |
|---|---|---|---|
| 903,648 | 11/1908 | Wiles | 403/381 X |
| 1,403,233 | 1/1922 | Collins | 217/65 |
| 1,468,786 | 9/1923 | Knechtel | 403/381 |
| 2,596,995 | 5/1952 | Hamilton | 217/65 X |
| 2,793,407 | 5/1957 | Johnston | 403/381 X |
| 3,090,086 | 5/1963 | Fata | 403/381 |
| 3,232,252 | 2/1966 | Nelson | 108/115 |
| 3,602,422 | 8/1971 | Dewhurst | 229/3.5 |
| 3,759,600 | 9/1973 | MacDonald | 312/348.1 |
| 4,170,313 | 10/1979 | Caves et al. | 220/7 |
| 4,443,046 | 4/1984 | Hannah | 312/183 |
| 4,632,345 | 12/1986 | Barley | 248/174 |
| 4,887,874 | 12/1989 | Joffe | 312/330.1 X |
| 5,348,386 | 9/1994 | Grass | 312/348.4 X |

*Primary Examiner*—Kenneth J. Dorner
*Assistant Examiner*—Robert J. Sandy
*Attorney, Agent, or Firm*—Richard B. O'Planick; Lisa B. Riedesel

[57] ABSTRACT

A drawer assembly is disclosed comprising a bottom panel (18), a rear panel (20), and first and second side panels (14,16) unitarily formed as an integral molding of plastics material, the panels being joined along edges by a flexible web (24) of plastic material. Hook projections (32) and a rib projection (34) of the side panels lock over pin projections (38) and grooves (42), respectively, of the rear panel to lock the rear and side panels into an upright configuration. A front panel (22) is provided which attaches to forward end surfaces of the side panels (14,16) to enclose the box. An end flange (48) is positioned along and project outward from the forward end surfaces of each side panel, the end flange being of T-shaped sectional profile and having a width which increases from a top end (50) to a bottom end (52). A pair of slots (54) extend into an inward surface of the front panel (22), each slot being of inverted T-shaped sectional profile and having a width which increases from a top end (56) to a bottom end (58). Assembly of he front panel (22) to the side panels (14,16) is achieved by moving the front panel downward against the forward end surfaces of the side panels, as the flanges (48) enter and progress down within the slots (54). Progressive frictional engagement between the flanges (48) and slot sidewalls cause the downward movement of the front panel to terminate when the front panel is in its intended final position.

18 Claims, 11 Drawing Sheets

DRAWER ASSEMBLY AND METHOD THEREFOR

BACKGROUND OF THE INVENTION

1. Field of the Invention

The invention relates generally to drawer assemblies for use with desk units, and, more specifically, to such drawer assemblies which are formed unitarily of plastic as a single molding and configured to form a drawer thereafter.

2. The Prior Art

A variety of plastic containers exist in the market, typically formed by conventional plastic molding operations such as injection molding or gas assisted molding. The containers are molded into a box shape and are subsequently shipped to their retail outlet in a nested stack in order to minimize shipping costs.

Despite efforts to minimize shipping costs by transporting containers in the nested stack, such costs still constitute a considerable component in the overall cost of the product to consumers. Hence, a need exists for a container which can be shipped in an even more compact configuration in order to reduce its cost.

It is also known to make cardboard or plastic containers out of a single blank such that the blanks may be shipped in a compact stack and subsequently formed into a container by the end user. U.S. Pat. No. 3,602,422 shows a composite container formed from a blank which is creased to fold into the shape of a box. Flaps are formed at the ends of the sidewalls and overlap the outside surface of an adjacent panel to create the container body. The flaps can be overlapped in a locking manner to hold the container in its shape. The container which results has a functional, utilitarian appearance, however, making it ill-suited for applications where a more finished appearance is desired. In addition, this structure is only capable of being manufactured from a material which is flexible, such as cardboard, and not from a more rigid material such as plastic.

U.S. Pat. No. 4,896,790 teaches a container which is formed unitarily out of a single plastic molding, having connective hinges along lower edges of the side and end panels. After the molding is formed, the side and end panels are rotated into an upright configuration. However, the container side and end panels must be welded together to retain their upright status, a procedure which adds to the cost of the product and which makes the product ill suited for applications where the containers are intended to be shipped in flat stacks for subsequent assembly by the end user, or for applications where the container is required to be repeatedly assembled and disassembled by the user.

From the foregoing, it will be appreciated that the industry is in need of a container which can be formed of plastic as a single molded blank, such that multiple containers can be shipped in a stack in order to minimize shipping costs. Moreover, each molded blank must be reconfigurable into the finished container by the end user, without specialized tools or materials. In addition, the molded blank must have means for securely retaining the side and end panels in an upright condition, yet the container should also facilitate its dissassembly by the end user if so desired. Finally, the container in the assembled state should ideally have smooth, uninterrupted inner and outer surfaces whereby creating a finished appearance. Such a capability is critical to certain product applications, e.g. as in furniture drawers, where appearance is vital to the acceptance of the product.

SUMMARY OF THE INVENTION

The subject invention overcomes the aforementioned deficiencies in known containers by providing an integral molding of plastic, configured to include a bottom, with first and second side panels and an end panel connected along a lower edge by a flexible web portion to the bottom. The container may be shipped and sold therefore in a stacked condition, whereby minimizing shipping and display costs.

The side panels and the end panel are pivoted by the user into an upright condition, and the end edges of the side panels and the end panel have interlocking projections which engage thereupon to hold the panels in place. Such interlocking engagement is accomplished without the need for handtools, and is reversible should the user wish to dissassembly the unit. Moreover, end surfaces of the interlocking projections are coplanar with the outward surfaces of the side and end panels, filling voids provided therein. Consequently, in the final form, the container inner and outer surfaces are continuous, producing a finished appearance suitable for serving such functions as a drawer.

A second end panel is provided for enclosing a forward end of the container. The second end panel is formed to include first and second slots extending within an inward facing surface proximate the ends, with each slot having a T-shaped sectional profile, and a width which increases from top to bottom. The side panels are provided with first and second end flanges which align with the second end panel slots, each end flange having a T-shaped sectional profile and a width which increases from top to bottom. Assembly of the second end panel to the container is effected by each slot receiving an end flange as the second end panel is moved downwardly against the forward edges of the side panels.

Accordingly, it is an object of the subject invention to provide a container which can be molded unitarily of plastic material by conventional processes.

A further object is to provide a container which is unitarily formed, transportable in a flat configuration, and capable of assembly and disassembly by the end user without the need for fasteners or tools.

Still a further object is to provide a container having the aforementioned characteristics and which is mechanically strong in its final configuration.

Another object is to provide a container having the aforementioned characteristics and which, in its final configuration, has smooth external and internal surfaces which produce a finished appearance.

The present invention also has an object to provide a container which is economically and readily manufactured and assembled, and which has a minimal number of component parts.

These and other objectives, which will be apparent to one skilled in the art, are achieved by a preferred embodiment which is described in detail below and which is illustrated by the accompanying drawings.

DESCRIPTION OF THE PREFERRED EMBODIMENT

Figure 1:
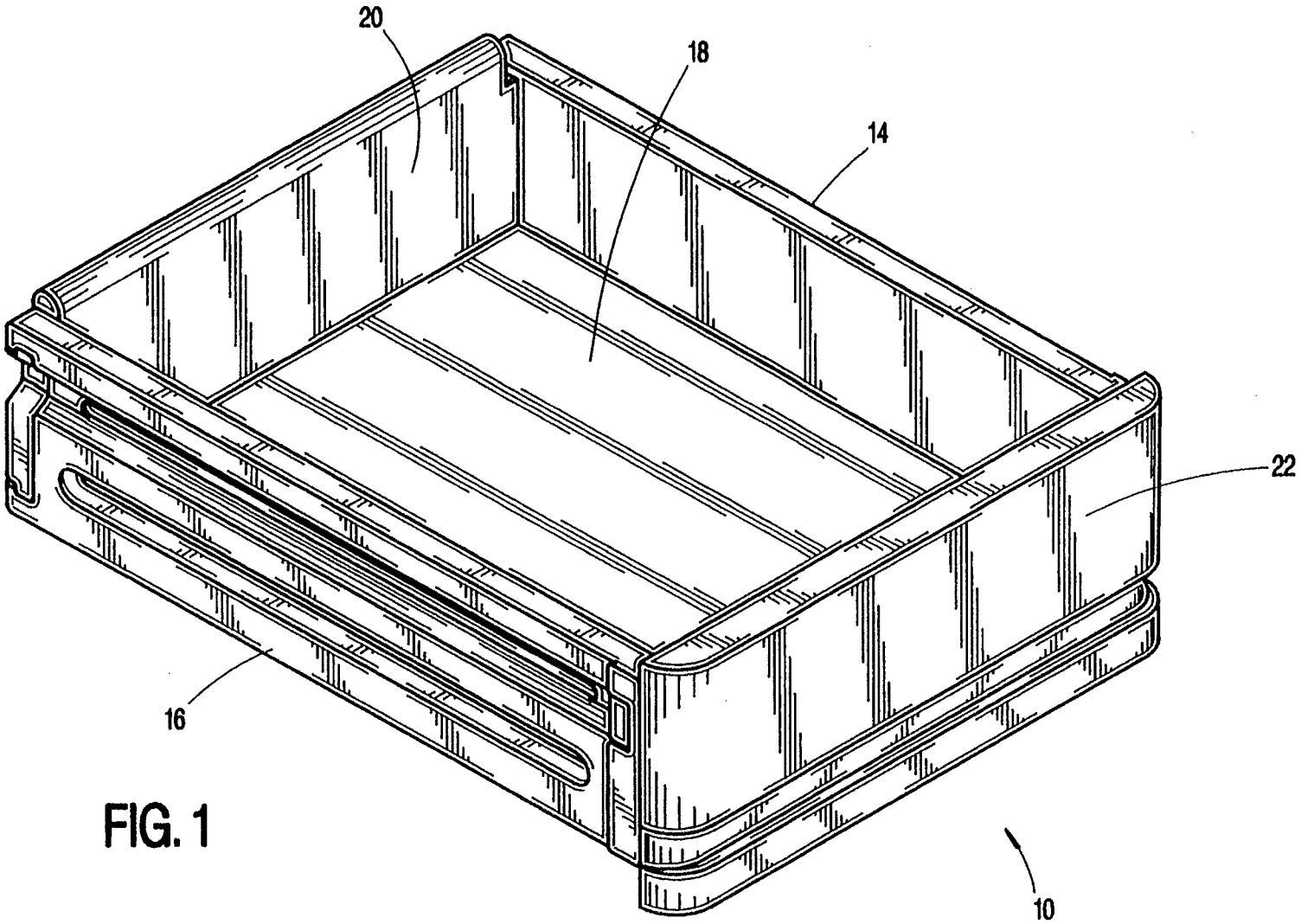
FIG. 1 is a perspective view of the container in the assembled condition.
Figure 2:
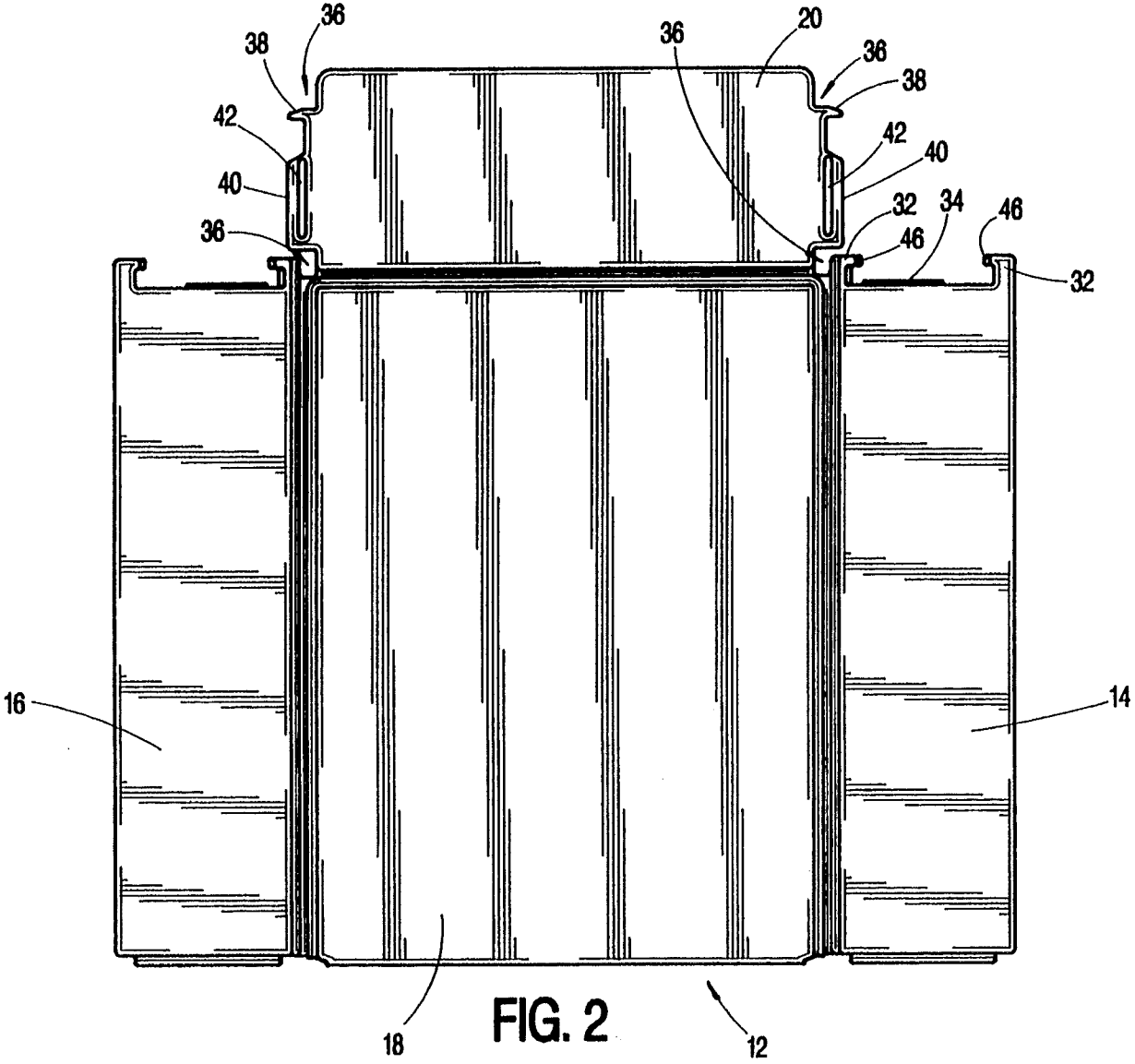
FIG. 2 is a top plan view of the container molding.
Figure 3:
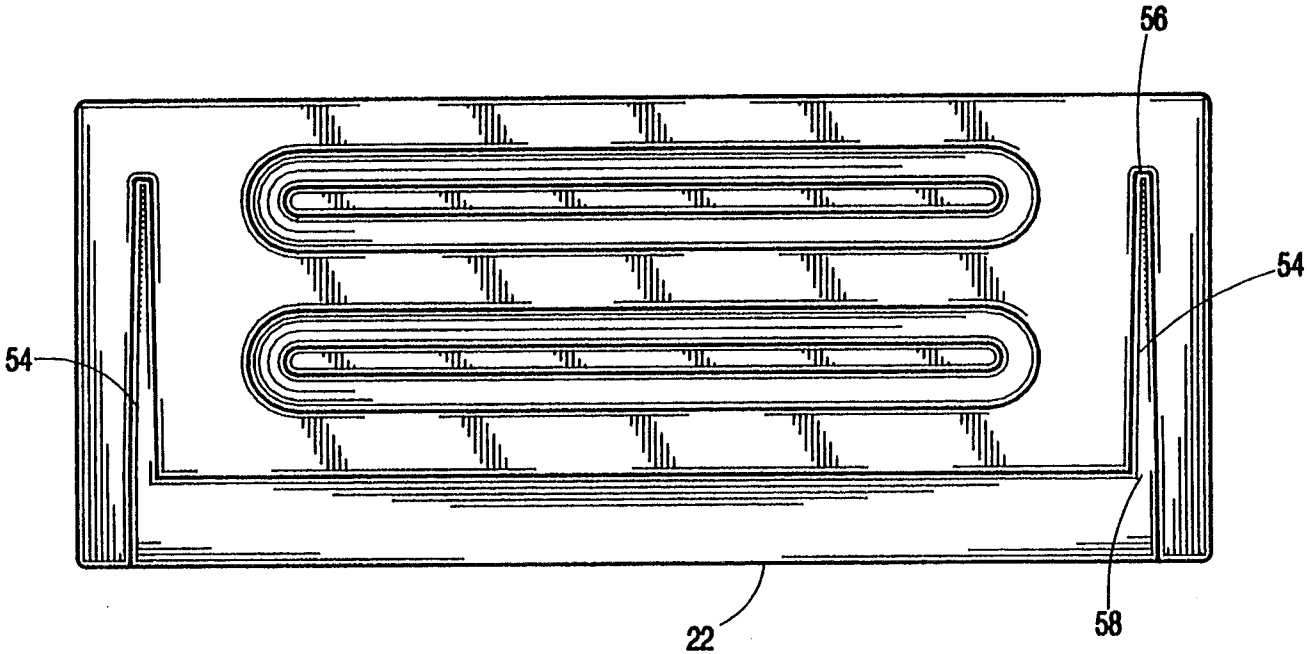
FIG. 3 is a rear elevation view of the front panel of the container.

Referring initially to FIGS. 1 and 2, it will be seen that the subject container assembly 10 is in the preferred form of a drawer. However, other containers for other applications, as will be apparent to those skilled in the art, may also be formed in accordance with the teachings herein set forth. The drawer configuration represented in FIG. 1 illustrates that, in the assembled condition, the container has a continuous, uninterrupted internal and external appearance which is aesthetically pleasing, making it suitable for those applications where appearance is a critical issue.

Continuing, the container assembly 10 comprises a main body 12 which is integrally molded of plastic, such as polyethylene, by a conventional plastic forming process, preferably by blow molding. The body 12 is shown in FIG. 2 in the form in which it is removed from the mold. It will be readily appreciated that multiple bodies 12 may be stacked and shipped in compact form for retail display, resulting in savings in transportation cost as well as conserving shelf space at retail.

The container body 12 comprises elongate sidewall panels 14,16, a bottom panel 18, and a rearward panel 20. A front panel 22 (FIG. 1) is shown as a separate assembly element for, in the preferred embodiment as a drawer, it is desirable that the container front be oversized. However, alternatively, the front panel may be integrally formed as part of the body 12, configured to be a mirror image to the rearward panel 20.

Figure 10:
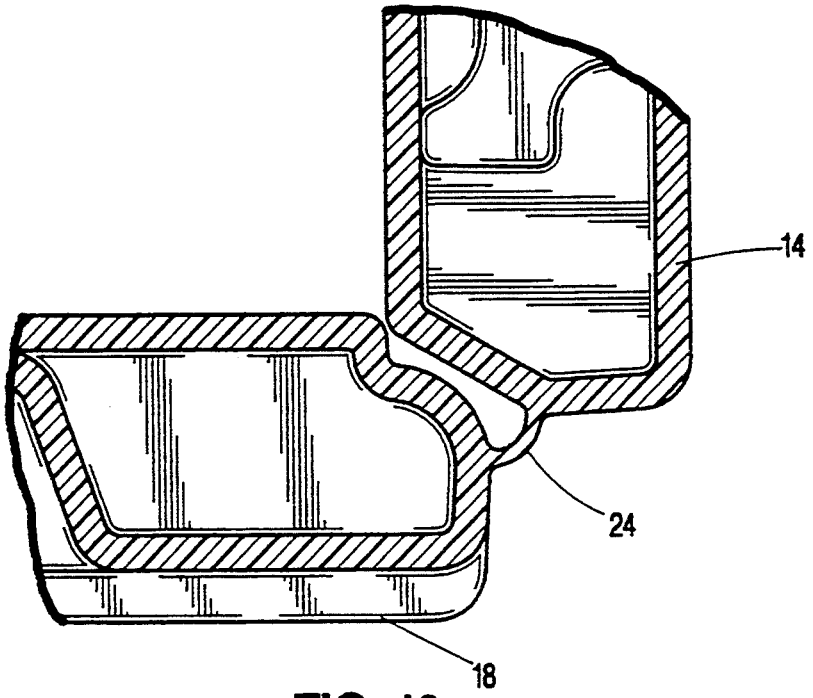
FIG. 10 is a section view through the side panel, taken along the line 10—10 of FIG. 4.

As best seen in FIG. 10, the sidewall panels 14,16 and the rearward panel 20 are connected along their lower longitudinal edges to corresponding edges of the bottom panel 18 by connective web portions 24. The web portions 24 are molded to be thinner in section than the panels and are flexible enough to allow panels 14,16, and 20 to pivot thereabout from the flat position shown in FIG. 2 to that shown in FIG. 1. The web portions 24 therefore serve as resilient hinges to allow such pivotal motion.

Figure 7:
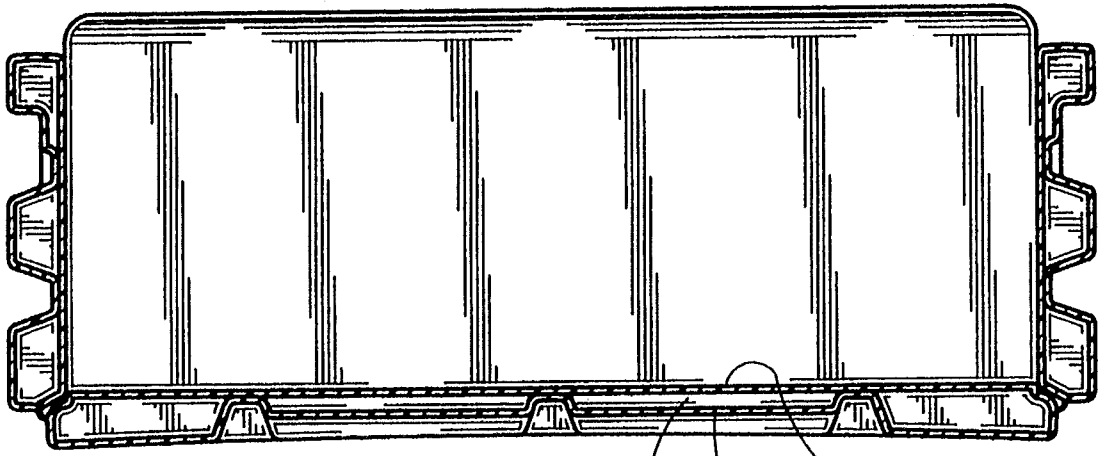
FIG. 7 is a transverse section view of the container assembly taken along the line 7—7 of FIG. 6.
Figure 8:
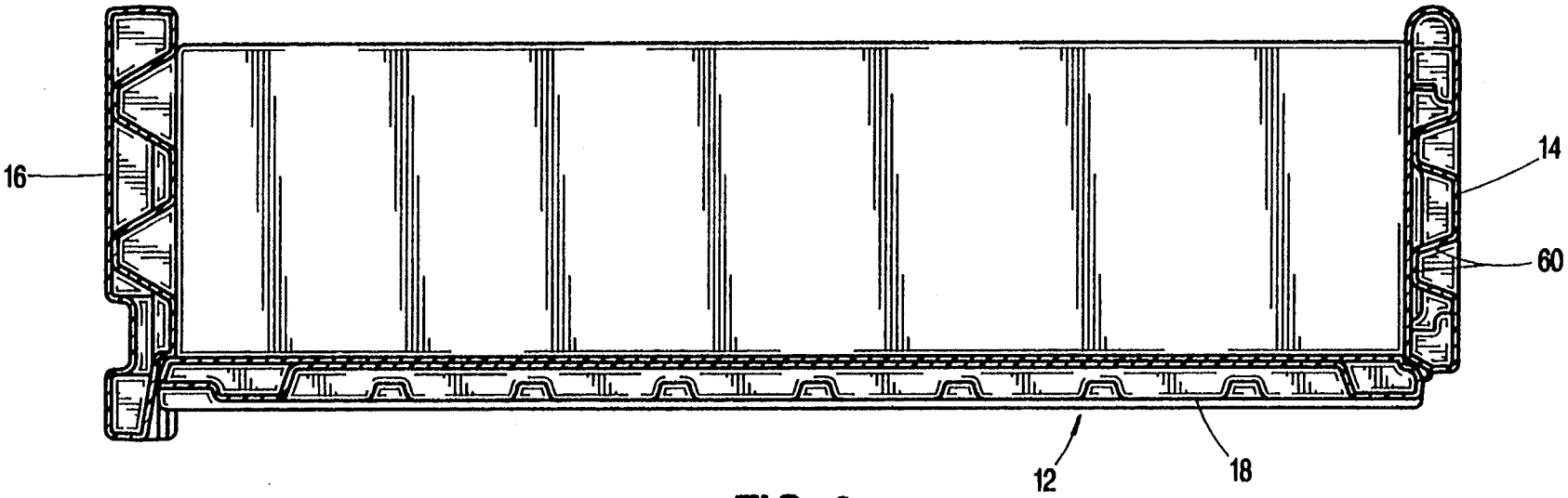
FIG. 8 is a longitudinal section view of the container assembly taken along the line 8—8 of FIG. 5.
Figure 9:
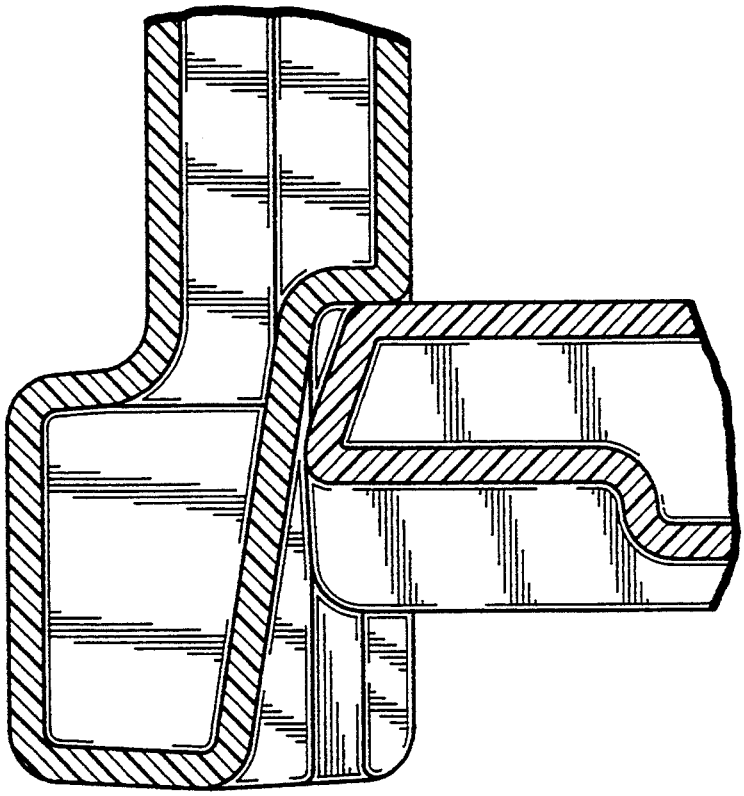
FIG. 9 is a section view through the front panel, taken along the line 9—9 of FIG. 6.

From FIG. 7 it will be appreciated that the panels 14, 16, 18, 20, and 22 are essentially hollow, each having an inner layer 26 and an outer layer 28 which are separated by an air gap 30. Such a configuration is the result of the blow molding process in which plastic material is inflated between two dies to form a part. The resultant part is light weight yet strong, and has a substantial, thick appearance. The part can be formed to have channels therein, extending along the external surface, as shown in FIG. 1 to increase the strength of the panel members as well as serving to add styling to the part.

Figure 4:
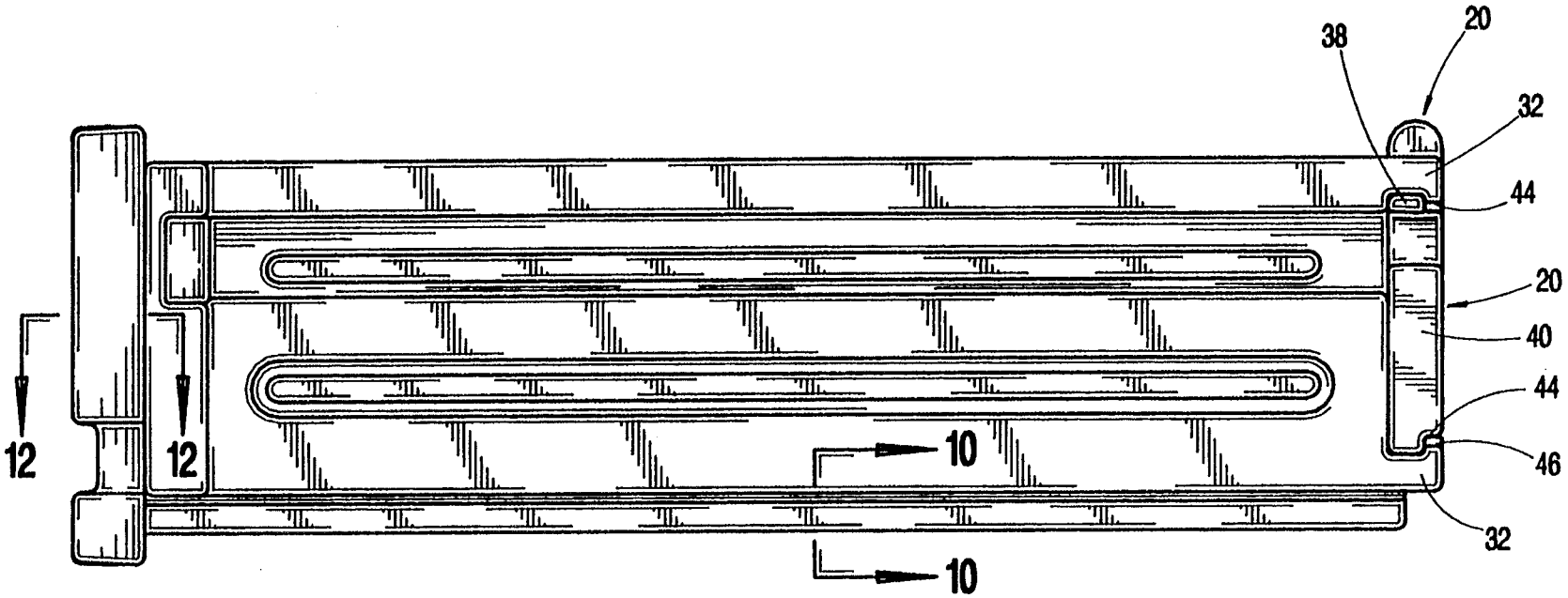
FIG. 4 is a side elevation view of the finished container assembly.
Figure 5:
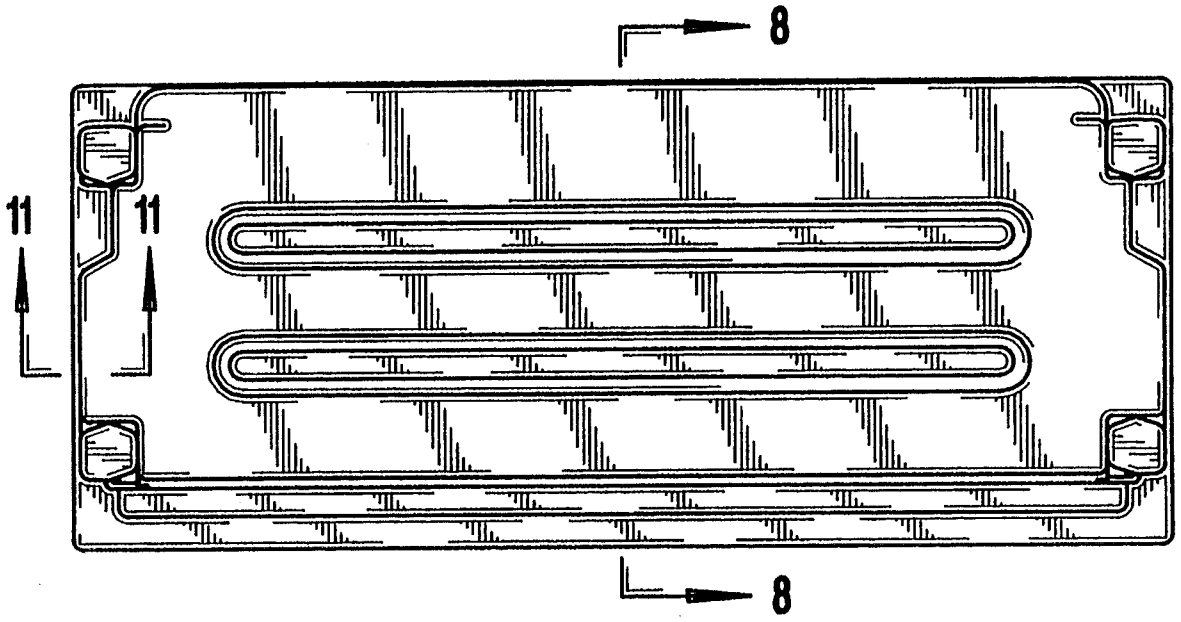
FIG. 5 is a rear elevation view of the finished container assembly.
Figure 6:
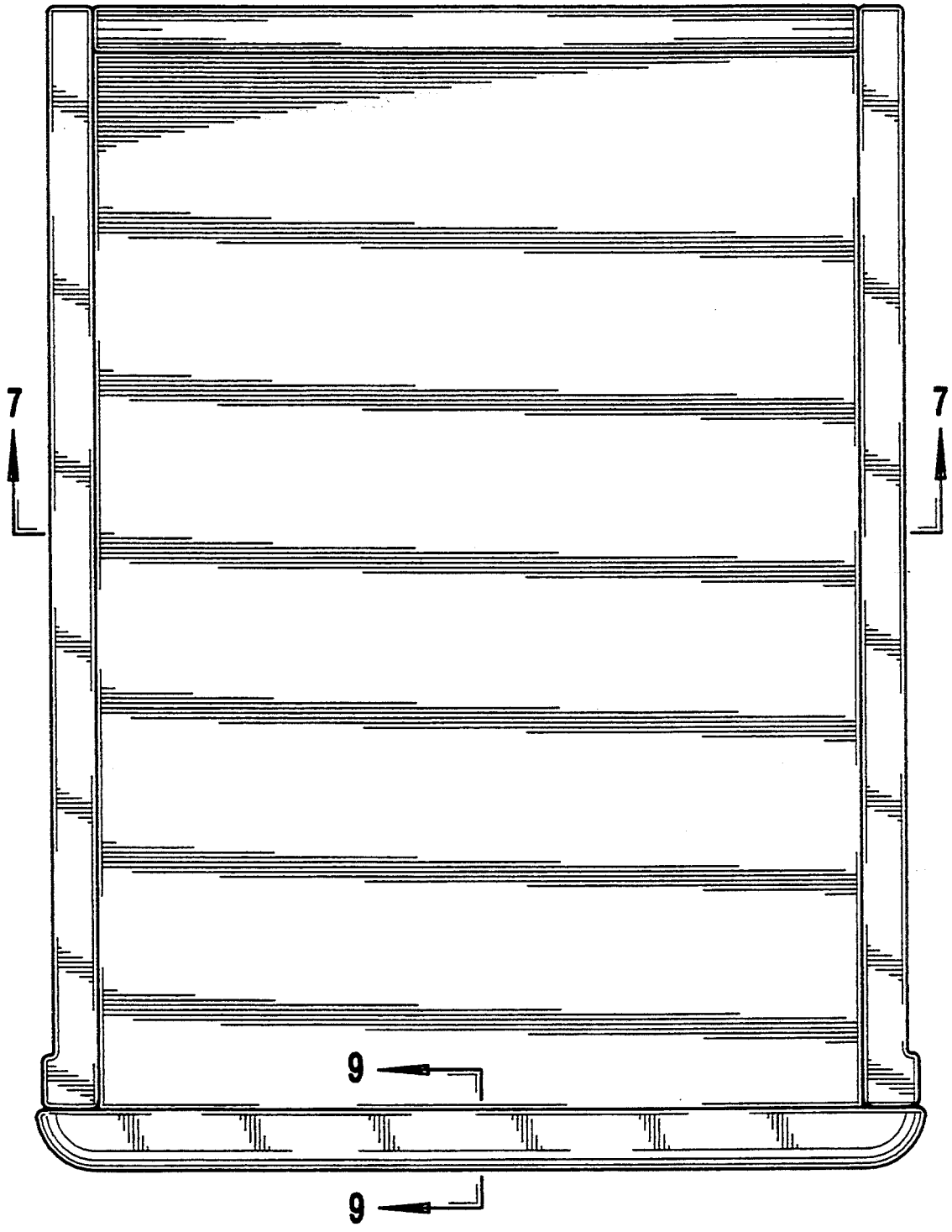
FIG. 6 is a top plan view of the finished container assembly.

With continued reference to FIGS. 1, 2, and 4, both the top and bottom of rearward corners of the side panels 14,16 are formed to include an outwardly projecting L-shaped locking hook 32. The locking hooks extend outward in parallel with longitudinal edges of the side panel, and have an end segment 46 which is formed at right angles to project inward toward the end segment 46 of the opposite locking hook 32. An outwardly projecting locking rib 34 extends along the end edge of each side panel, disposed between the end segments 46 of the locking hooks 32.

The rearward end panel 20 is formed to provide openings 36 at both top and bottom corners; and an outwardly projecting pin projection 38 extending from the end edges of the rearward panel and separated from a top corner of the rearward panel by one of the openings 36.

Figure 11:
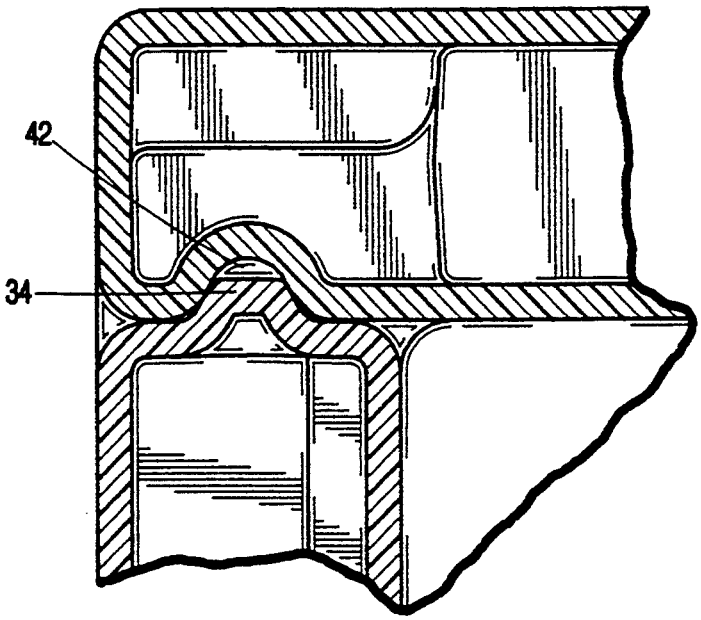
FIG. 11 is a section view through the rear panel, taken along the line 11—11 of FIG. 5.

An edge flange 40 extends outward from each end edge of the rearward panel 20, and is generally rectangular in plan view. The flange 40, as best shown by FIG. 4, is formed to span the cross-sectional width of the rearward panel 20. A vertically extending groove 42 extends into an inward facing side of the flange 40, located and configured to receive in interference fashion the locking rib 34 of one sidewall. FIG. 11 shows the locking rib 34 in position within the groove 42.

Continuing, as best shown by FIG. 4, two sockets 44 are formed in the two ends of the rearward panel 20 to receive the end segments 46 of the hooks 32 from the two sidewalls. One of the sockets is located outward of each locking pin 38, at the top of the rearward panel, and a second socket 44 is formed as an undercut in the lower edge of each flange 40.

Referring to FIG. 4, it is seen that the width of the locking pins 38 and the lower edge of the edge flange 40 are less than the nominal width of the rear panel 20, such that the sockets 44 are formed adjacent to and to the rear of the pins 38 and the lower edge of the edge flange 40. Sockets 44 accept the end segments 46 of the hooks 32 of the side panels. It will further be noted that the length of the hooks 32 is substantially equivalent to the nominal width of the rear panel 20, such that, with the container in the assembled upright condition of FIG. 4, remote end surfaces of the hooks 32 are coplanar with the outward surface of the rear panel 20. Resultingly, the interlocking of the side and rear panels is accomplished in a manner which preserves the continuity of the outward surfaces of the container. A finished, and acceptably aesthetic appearance is thus attained, making the container suitable for style oriented applications such as for a drawer.

In addition, as seen from FIG. 1, the interior of the container is smooth and continuous, devoid of any irregularities from the interlocking structure of the side and rear panels. The interior of the container therefore presents no edges or interruptions on which contents of the container could become entangled.

From FIGS. 1, 2, and 4, the assembly of the main body of the container proceeds as follows. The single molding shown in flat form in FIG. 2 may be shipped in stacks to the end user for reformation, thereby reducing the cost of shipment. Moreover, the containers may even be displayed in stacked form at retail in order to conserve shelf space.

Assembly of the container proceeds without the need for any hand tools or fasteners, as follows. The rearward panel 20 is first brought into its upright condition, followed by the side panels 14,16. As the side panels reach their vertical final orientation, the hook elements 32 of the side panels 14,16 engage over the pin projections 38 and the lower edges of flanges 40 of the rearward panel. Simultaneously, the rib projections 34 of the sidewalls enter into the flange grooves 42 of the rearward panel. The interfitting of the hooks and rib projections proceeds without the need for hand tools.

In the upright configuration, the side panels and rearward panel are interlocked together to form a box which can be used for myriad purposes. The hook elements 32 prevent the rearward panel 20 from pivoting outward; and the rib projections 34 within the flange grooves 42 prevent the sidewall panels from pivoting outward. Moreover, the hook elements 32, by hooking over the pin projections 38 and the underside of flanges 40 prevent the rearward panel and side panels from moving in the vertical direction. Hence, the interlocking of the panels together is accomplished in such a way so as to render the panels immobile in all three dimensional directions. If so desired, however, the frictional engagement may be overcome by the application of manual force, and the box can be made to assume the flat orientation of FIG. 2 for storage.

The aesthetic appearance of the box, as will be appreciated from FIG. 1, is suitable for many applications where appearance is a prerequisite, yet the box is inexpensive to produce, requiring no assembly hardware and being formed of conventional plastics material by conventional mass production processes. Also, as described above, assembly and disassembly are easy and require no hand tools.

Figure 12:
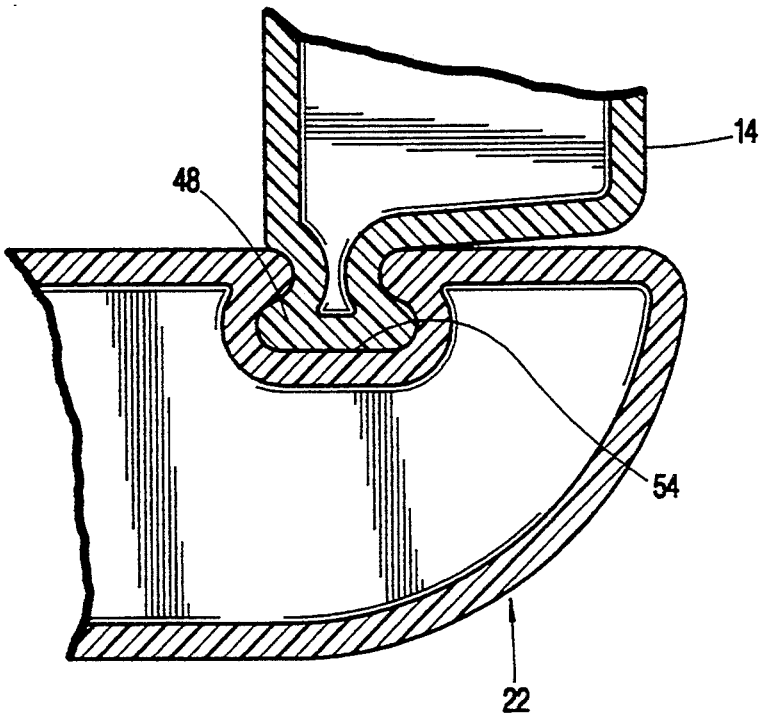
FIG. 12 is a section view through the front panel, taken along the line 12—12 of FIG. 4.
Figure 13:
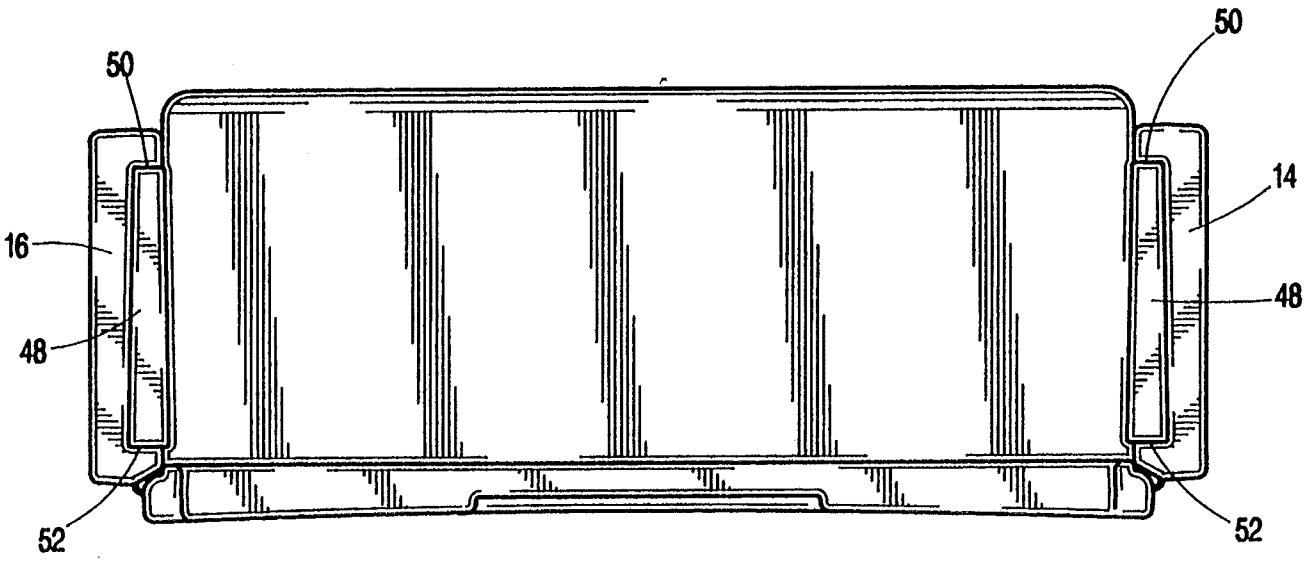
FIG. 13 is a front elevation view of the container assembly with the from panel removed.

Referring to FIGS. 12 and 13, the forward ends of the sidewall panels 14, 16 are each provided with a vertically extending, elongate end flange 48. The end flange has a T-shaped sectional profile and tapers in width from a lower end 52 to an upper end 50, and is generally centered between the upper and lower ends of the sidewall panel ends. The shape of the end flanges in section is shown in FIG. 12.

Referring to FIGS. 7, 12, and 13, the front panel 22 is shown to be an integrally molded, single molding body which is provided with a pair of vertically extending slots 54 in an inward directed surface. The slots 54 are spaced apart a distance corresponding to the spacing between the sidewalls 14, 15 of the main body 12. The slots 54 have an inverted T-shaped sectional profile and taper in width from a relatively wide open lower end 58 to a closed, relatively narrow upper end 56. The sectional configuration of the slots 54 will be understood from FIG. 12. The purpose for the tapering shape of the slots 54 will be appreciated from the following.

To assemble the front panel 22 to the forward edges of the sidewall panels 14, 16, the front panel 22 is first positioned so that its slots 54 are aligned with and disposed above the sidewall panel flanges 48. The front panel 22 is moved downward, substantially perpendicular to the sidewall panels 14, 16 and, in so moving, the narrow end of the flanges 48 enter into the wide end of the slots 54. Further progression of the front panel downward causes flanges 48 to move further into the slots 54 until a frictional fit is established, represented in FIG. 12. The sizing of the slots and flanges is selected such that the frictional fit is accomplished when the front panel 22 reaches a centered alignment with the end edges of the sidewall panels 14, 16.

It will be appreciated that the tapered configuration of the slots 54 and flanges 48 enables the front panel to move initially downward with no resistance until it substantially reaches its final position. Assembly of the panel 22 can thus be readily accomplished without an requiring an excessive amount of force or strength. The external shape of the front panel 22 is contoured to provide a decorative appearance, suitable for a drawer or the like. The front panel 22 can be assembled to the box body by the end user without hand tools, and can be disassembled by reversing the above procedure.

From the foregoing, it will be noted that formation of the box body 12 could be achieved by integrally molding a front panel to the forward lower corners of the sidewall panels, if so desired. In such an alternative embodiment of the present invention, the front panel would be configured as a mirror image to the rearward panel. The front panel would then pivot upward and engage the forward sidewall edges, in the manner described above in regard to the rearward panel 20. Thus, the single molding could be formed into a four sided box.

In yet another alternative embodiment of the subject invention, the rearward panel 20 and rearward edges of the sidewall panels 14,16 could be configured to assemble as described above for the forward panel 22 and forward sidewall panel edges, if so desired. The body of the box would be enclosed by moving the front and rearward panels downward against the front and rearward edges of the sidewall panels to enclose the box.

The purpose and advantage of making the front panel apart from the main body of the box is to enable it to take a different form for aesthetic reasons. Also, as will be apparent from FIG. 1, the lower edge of the front panel 22 hangs below the lower edges of the sidewall panels 14,16 to abut against the front panel of a cabinet or desk (not shown). Forming the front panel separately allows for the lower edge to depend downward at the front.

While the above describes the preferred embodiment of the subject invention, the invention is not intended to be so confined. Other embodiments, which will be apparent to one skilled in the art, and which utilize the teachings herein set forth, are intended to be within the scope and spirit of the invention as well.

I claim:

1. A drawer assembly comprising:

a bottom and first and second sidewall panels unitarily formed as an integral molding of plastics material, the sidewall panels connected along a lower edge to opposite sides of the bottom panel by flexible web portions and pivoting about the web portions from a flat orientation into an upright orientation, whereby forming a container body;

an end panel connected along a lower edge to an end edge of the bottom panel by a flexible web portion and pivoting about the web portion from a flat orientation into an upright orientation, whereby enclosing an end of the container body; and interlocking projections which extend outward from end edges of the end panel and the sidewall panels and which engage, whereby preventing the end panel and sidewall panels from pivoting out of their upright orientation;

and the interlocking projections comprising a horizontal pin appendage projecting perpendicularly from an end edge of the end panel, spaced a distance below a top edge of the end panel, and further comprising a hook appendage positioned to overlap and capture the pin appendage as the end panel and the sidewall panels are placed in their respective upright orientations, and the hook appendage comprises a first segment which extends parallel to and outward from a side edge of a sidewall panel, and perpendicular to the end edge of the sidewall panel, and a second hook appendage segment which extends from a distal end of the first hook appendage segment in a parallel orientation to the end edge of the sidewall panel.

2. A drawer assembly according to claim 1, wherein the first hook segment has a width substantially equivalent to the distance which the pin appendage is spaced below the top edge of the end panel.

3. A drawer assembly according to claim 4, wherein the rib flange is integrally formed to extend along a rearward end edge of each of the sidewall panels.

4. A drawer assembly according to claim 3, wherein the end edges of the end panel each have a centrally disposed and outwardly projecting edge flange and the detent groove extends into an inward facing surface of each of the edge flanges.

5. A drawer assembly comprising;

a bottom and first and second sidewall panels unitarily formed as an integral molding of plastics material, the sidewall panels connected along a lower edge to opposite sides of the bottom panel by flexible web portions and pivoting about the web portions from a flat orientation into an upright orientation, whereby forming a container body;

an end panel connected along a lower edge to an end edge of the bottom panel by a flexible web portion and pivoting about the web portion from a flat orientation into an upright orientation, whereby enclosing an end of the container body; and interlocking projections which extend outward from end edges of the end panel and the sidewall panels and which engage, whereby preventing the end panel and sidewall panels from pivoting out of their upright orientation;

and the interlocking projections comprising a horizontal pin appendage projecting perpendicularly from an end edge of the end panel, spaced a distance below a top edge of the end panel, and further comprising a hook appendage positioned to overlap and capture the pin appendage as the end panel and the sidewall panels are placed in their respective upright orientations, and further comprising a second end panel attaching to forward end edges of the sidewall panels, whereby enclosing the container body and first and second elongate end flanges which extend along and project outward from the forward end edges of the sidewall panels, the end flanges being of T-shaped sectional configuration and of increasing width from a top end to a bottom end; and first and second elongate slots within an inward surface of the second end panel, proximate first and second ends of the second end panel, each slot being of T-shaped sectional configuration and of increasing width from a top end to a bottom end and positioned to receive the second panel end flanges therein as the second end panel is moved downward and against the forward end edges of the sidewall panels.

6. A drawer assembly according to claim 5, wherein the elongate slots and the elongate end flanges are dimensioned in section for progressive frictional engagement as the second panel is moved in the downward direction.

7. A drawer assembly comprising:

a bottom and first and second sidewall panels unitarily formed as an integral molding of plastics material, the sidewall panels connected along a lower edge to opposite sides of the bottom panel by flexible web portions and pivoting about the web portions from a flat orientation into an upright orientation, whereby forming a container body;

a first end panel connected along a lower edge to an end edge of the bottom panel by a flexible web portion and pivoting about the web portion from a flat orientation into an upright orientation, whereby enclosing one end of the container body; interlocking projections which extend outward from end edges of the end panel and the sidewall panels and which engage, whereby preventing the end panel and sidewall panels from pivoting out of their upright orientation;

a second end panel attached to forward end edges of the sidewall panels, whereby enclosing a second end of the container body;

first and second elongate end flanges positioned to extend along and project outward from the forward end edges of the sidewall panels, the end flanges being of T-shaped sectional configuration and of increasing width from a top end to a bottom end; and first and second elongate slots within an inward surface of the second end panel, proximate first and second ends of the second end panel, each slot being of T-shaped sectional configuration and of increasing width from a top end to a bottom end and positioned to receive the end flanges of the sidewall panels therein as the second end panel is moved downwardly against the forward end edges of the sidewall panels.

8. A drawer assembly according to claim 7, wherein the elongate slots and the elongate end flanges are dimensioned in section for progressive frictional engagement as the second end panel is moved in the downward direction.

9. A drawer assembly according to claim 8, wherein the interlocking projections comprise a horizontal pin appendage and a hook appendage positioned to overlap and capture the pin appendage as the first end panel and the sidewall panels pivot into their respective upright orientations.

10. A drawer assembly according to claim 9, wherein the interlocking projections further include a rib flange and a corresponding detent groove positioned and dimensioned to closely receive the rib flange therein as the end panel and the sidewall panels pivot into their respective upright orientations.

11. A drawer assembly according to claim 10, wherein the interlocking projections interfit spatially between boundaries formed by inner and outer surfaces of the sidewall and end wall panels, whereby the inner and outer surfaces of the sidewall and end wall panels are uninterrupted by the interlocking projections when in the upright orientation.

12. A drawer assembly according to claim 11, wherein the elongate edge flanges and slots of the sidewall panels and the second end panel interfit, whereby the inner and outer surfaces of the sidewall and second end panel are uninterrupted in the upright orientation.

13. A drawer assembly comprising:

a bottom and first and second sidewall panels, the panels each having an inward and an outward facing surface, and the panels unitarily formed as an integral molding of plastics material, the sidewall panels connected along a lower edge to opposite sides of the bottom panel by flexible web portions and pivoting about the web portions from a flat orientation into an upright orientation, whereby forming a container body;

an end panel connected along a lower edge to an end edge of the bottom panel by a flexible web portion and pivoting about the web portion from a flat orientation into an upright orientation, whereby enclosing one end of the container body;

locking projections which extend outward from end edges of the sidewall panels and which interfit and engage end edges of the end panel to prevent the end panel and sidewall panels from pivoting out of their upright orientation; and the locking projections of the sidewall panels extend outward a distance substantially equivalent to the spacing between the inner and outer surfaces of the end panel; and the end panel comprising locking projections which extend outward from the end edges of the end panel and engage end edges of the sidewall panels, the end panel locking projections extend outward a distance substantially equivalent to the spacing between the inner and outer surfaces of the sidewall panels.

14. A drawer assembly according to claim 13, wherein the locking projections of the end panel and the sidewall panels mutually engage.

15. A drawer assembly according to claim 14, wherein the locking projections of the end panel have distal end surfaces which are coplanar with the outer surface of the sidewall panels, and the locking projections of the sidewall panels have distal end surfaces which are coplanar with the outer surface of the end panel.

16. A drawer assembly according to claim 15, wherein the assembly further comprising a second end panel attaching to forward edges of the sidewall panels, whereby enclosing the container body.

17. A drawer assembly according to claim 16, wherein further comprising: first and second elongate end flanges which extend along and project outward from a forward edge of each of the sidewall panels, the forward end edges of the sidewall panels, the end flanges being of T-shaped sectional configuration and of increasing width from a top end to a bottom end; and first and second elongate slots within an inward surface of the second end panel proximate first and second ends of the second end panel, each slot being of complementary T-shaped sectional configuration and of increasing width from a top end to a bottom end and positioned to receive the second panel end flanges therein as the second end panel is moved downward and against the forward end edges of the sidewall panels.

18. A drawer assembly according to claim 17, wherein the elongate slots and elongate end flanges are dimensioned in section for progressive frictional engagement as the second panel is moved in the downward direction.

* * * * *

UNITED STATES PATENT AND TRADEMARK OFFICE

CERTIFICATE OF CORRECTION

PATENT NO. : 5,433,518
DATED : July 18, 1995
INVENTOR(S) : Erik L. Skov

It is certified that error appears in the above-indentified patent and that said Letters Patent is hereby corrected as shown below:

Column 10, line 19, delete "forward end edges of the sidewall panels,"

Signed and Sealed this

Thirty-first Day of October 1995

*Attest:*

*Attesting Officer*

BRUCE LEHMAN

*Commissioner of Patents and Trademarks*